US006861600B1

(12) United States Patent
Schulz et al.

(10) Patent No.: US 6,861,600 B1
(45) Date of Patent: Mar. 1, 2005

(54) INTEGRATED SWITCH AND BACKLIGHT ASSEMBLY

(75) Inventors: Walter B. Schulz, Strongsville, OH (US); David J. Page, Painesville, OH (US)

(73) Assignee: Lumitex, Inc., Strongsville, OH (US)

( * ) Notice: Subject to any disclaimer, the term of this patent is extended or adjusted under 35 U.S.C. 154(b) by 0 days.

(21) Appl. No.: 10/676,617

(22) Filed: Oct. 1, 2003

(51) Int. Cl.[7] ..... H01H 9/00; H01H 13/705; H01H 1/00

(52) U.S. Cl. ..... 200/310; 200/313; 200/314; 200/343; 200/512

(58) Field of Search ..... 200/5 A, 5 R, 200/512–517, 308–317, 341–343; 362/23, 26, 31, 34, 84, 94, 95; 349/56–61, 139–152

(56) References Cited

U.S. PATENT DOCUMENTS

| | | | | |
|---|---|---|---|---|
| 4,163,883 A | * | 8/1979 | Boulanger | 200/314 |
| 4,247,747 A | | 1/1981 | Swatten | 200/314 |
| 4,343,975 A | | 8/1982 | Sado | 200/314 |
| 4,449,024 A | * | 5/1984 | Stracener | 200/317 |
| 4,638,131 A | * | 1/1987 | Kidd et al. | 200/5 A X |
| 4,772,769 A | | 9/1988 | Shumate | 200/314 |
| 5,521,342 A | | 5/1996 | Bartley et al. | 200/5 A |
| 5,568,367 A | * | 10/1996 | Park | 200/314 X |
| 5,612,692 A | * | 3/1997 | Dugas et al. | 200/5 R |
| 5,655,826 A | * | 8/1997 | Kouno et al. | 200/314 X |
| 5,975,711 A | | 11/1999 | Parker et al. | 362/24 |

FOREIGN PATENT DOCUMENTS

GB 2 285 518 A 1/1995

* cited by examiner

*Primary Examiner*—James R Scott
(74) *Attorney, Agent, or Firm*—Renner, Otto, Boisselle & Sklar, LLP

(57) ABSTRACT

Integrated switch and backlight assembly includes a flexible light panel disposed between a circuit board and a keypad for backlighting the keypad. On the back side of the light panel is a back reflector having a plurality of contacts for selectively establishing electrical contact with the circuit board upon actuating selective portions of the keypad to cause corresponding portions of the light panel and back reflector to flex toward the circuit board.

25 Claims, 2 Drawing Sheets

INTEGRATED SWITCH AND BACKLIGHT ASSEMBLY

FIELD OF THE INVENTION

This invention relates to a switch and backlight assembly in which the backlight is integrated into the switch to provide a more cost effective and thinner switch/backlight assembly.

BACKGROUND OF THE INVENTION

Fiber optic light panels are commonly used to backlight dome type membrane switches and the like. The light panel is placed between the domes and a semi-transparent or translucent overlay. When the overlay is depressed, the light panel is selectively deflected into contact with respective domes, causing electrical contact to be made between the domes and conductive contacts on a circuit board underlying the domes.

Keypads with conductive contacts adhered to respective keys are also commonly used to make electrical contact with conductive contacts on a circuit board to activate respective switches. Heretofore it wasn't practical to backlight keypads with conductive contacts using fiber optic panels because the fiber optic panels interfered with electrical contact between the conductive contacts on the keys and the circuit board. However, it has been found that by integrating the light panel into the switch, a more reliable, cost effective and thinner switch and backlight assembly may be provided.

SUMMARY OF THE INVENTION

The present invention relates to a switch and backlight assembly including a light emitting panel that is integrated into the switch to provide a more reliable, cost effective and thinner backlighted switch assembly.

In accordance with one aspect of the invention, a flexible light emitting panel member is disposed between the keypad and the circuit board for backlighting the keypad. On the back side of the panel member is a back reflector provided with conductive contacts. Accordingly, when the keys are selectively actuated, associated portions of the panel member are flexed toward the circuit board, causing electrical contact to be established between respective contacts on the back reflector and the circuit board.

In accordance with another aspect of the invention, the back reflector contacts may be surrounded by spacers to protect the contacts from contaminants for greater reliability.

In accordance with another aspect of the invention, the spacers may be formed by a spacer layer covering the exterior surface of the back reflector, with holes through the spacer layer in alignment with the back reflector contacts for exposing the back reflector contacts to the respective circuit board contacts. Alternatively, the spacer layer and back reflector may be integrated into a single layer as by vacuum forming or molding the back reflector and spacers surrounding the contacts as a single unit.

These and other objects, advantages, features and aspects of the invention will become apparent as the following description proceeds.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE INVENTION

Figure 1:
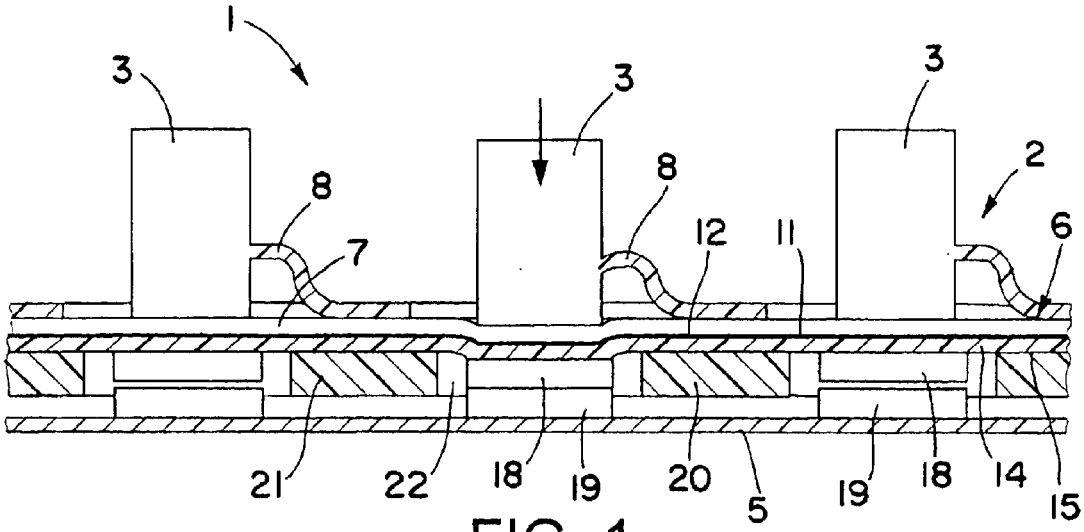
FIG. 1 is a schematic fragmentary transverse section through a portion of one form of an integrated switch and backlight assembly of the present invention.
Figure 2:
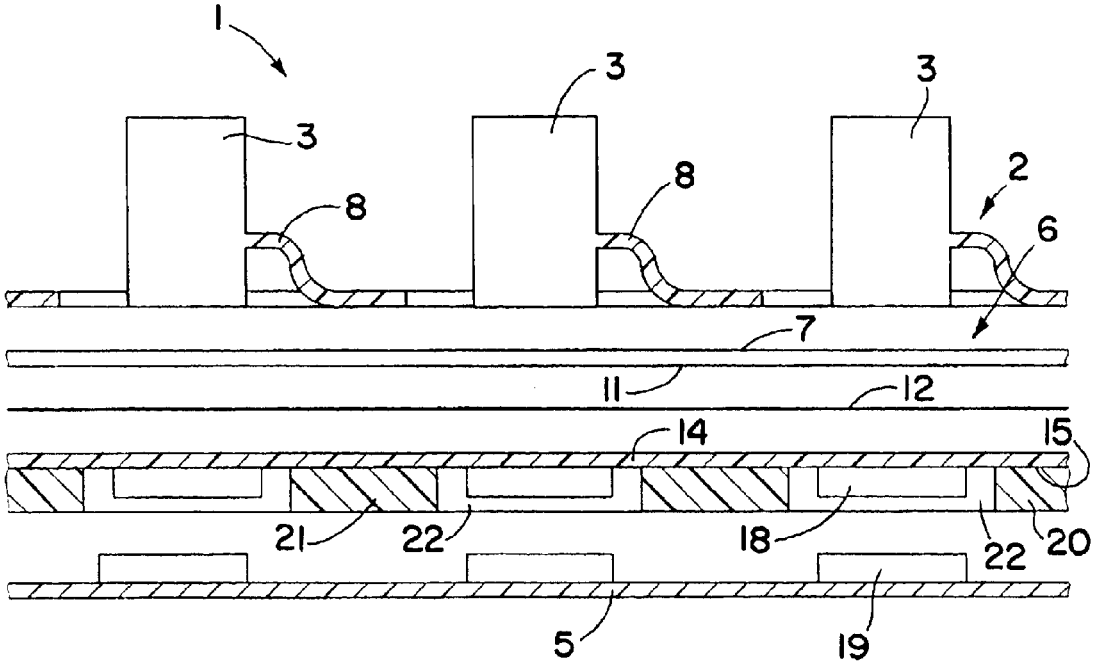
FIG. 2 is an exploded view of the portion of the integrated switch and backlight assembly shown in FIG. 1.

Referring now in detail to the drawings, FIGS. 1 and 2 schematically show a portion of an integrated switch and backlight assembly 1 in accordance with the invention, including a keypad 2 having a plurality of keys 3 which when selectively actuated activate respective switch contacts associated with each of the keys as described hereafter. Upon release of the keys, the keys return to their original positions.

Spaced from keypad 2 is a circuit board 5 having a desired conductive trace thereon. Between the keypad 2 and circuit board 5 is a flexible light conducting panel member 6 that receives light from one or more light sources (not shown) for emission of the light at selective locations along the length of the panel member for backlighting the keys, as well known in the art. Panel member 6 may comprise one or more layers of flexible optical fibers 7. Alternatively, panel member 6 may comprise a flexible optically transparent film, sheet or plate as desired.

Figure 3:
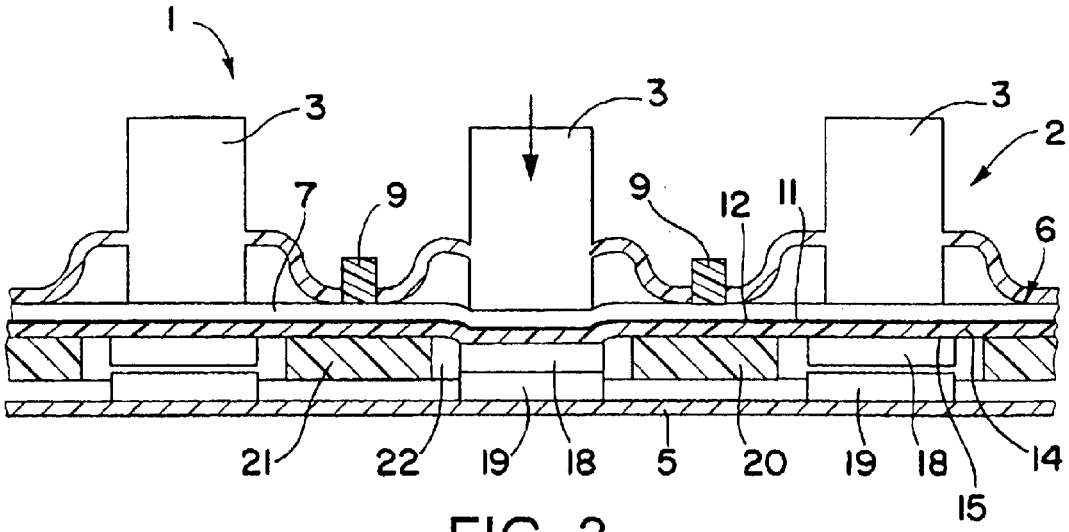
FIGS. 3 and 4 are schematic fragmentary transverse sections through a portion of other integrated switch and backlight assemblies of the present invention which differ from the integrated switch and backlight assembly shown in FIGS. 1 and 2 in the type of keyboard used to support keys for movement toward and away from the backlight assembly.
Figure 4:
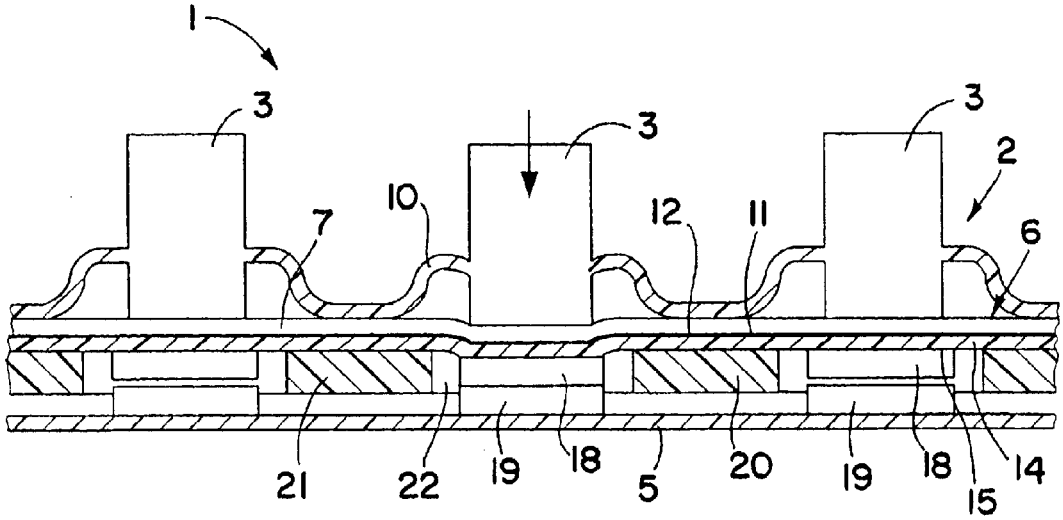

The keys 3 may be rigid and the keypad 2 formed as a single unit with flexible joints 8 between the keys to permit selective movement of the keys toward and away from the light panel 6 as schematically shown in FIGS. 1 and 2. Alternatively, the rigid keys 3 may be held in a frame or housing 9 to permit selective movement of the keys toward and away from the light panel 6 as schematically shown in FIG. 3. Further, the keypad 2 may include a flexible elastomeric membrane 10 to permit selective movement of the keys 3 toward and away from the light panel as schematically shown in FIG. 4. Otherwise, the integrated switch and backlight assemblies shown in FIGS. 3 and 4 may be substantially the same as that shown in FIGS. 1 and 2 and accordingly the same reference numbers are used to designate like parts.

Attached to the back side 11 of panel member 6 as by means of a pressure sensitive adhesive 12 is a reflective layer 14 for reflecting light back out the other side of the panel member for backlighting the keys. On the back side 15 of back reflector 14 are a plurality of conductive contacts 18 which may, for example, be conductive ink that is printed onto the back reflector. These conductive contacts 18 may be in line with respective keys 3 on keypad 2 and respective conductive contacts 19 on circuit board 5, whereby when one or more keys 3 are selectively depressed, the depressed keys will cause respective portions of panel member 6 to flex toward the circuit board to establish electrical contact between the respective conductive contacts 18, 19 on the back reflector and the circuit board. For example, the middle key 3 of FIGS. 1, 3 and 4 is shown depressed to establish electrical contact between the respective middle contacts 18, 19.

Suitable spacers 20 may surround each of the back reflector contacts 18 to protect the contacts from contaminants for greater reliability. Spacers 20 may be formed as by adhesively attaching a spacer film layer 21 made, for example, of a compressible foam-like material, to the back side of back reflector 14. The spacer layer 21 may have holes 22 extending therethrough in line with the back reflector contacts 18 for exposing the back reflector contacts to the circuit board contacts 19. Alternatively, the spacers 21 and back reflector 14 may be integrated into a single layer as by vacuum forming or molding the back reflector and spacers surrounding the contacts 18 as a single unit.

By integrating the backlight 6 into the switch 1 so that one of the conductive contacts 18 of the respective switches are part of the backlight in the manner previously described allows the assembly to be made thinner, simpler and more reliable. Also, this allows a single light source such as a light emitting diode to be used to backlight a larger area, thus lowering power consumption. Moreover, additional circuit logic may be laid out on the back reflector if desired without having any impact on the tactile feel of the switches.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the invention. In addition, while a particular feature of the invention may have been disclosed with respect to only one embodiment, such feature may be combined with one or more other features as may be desired and advantageous for any given or particular application.

What is claimed is:

1. A switch and backlight assembly comprising a keypad, a circuit board spaced from the keypad, and a flexible light panel between the keypad and circuit board for backlighting the key pad, the light panel having a back reflector on a side facing away from the keypad, and the back reflector having a plurality of contacts on a side facing the circuit board for establishing electrical contact of one or more of the contacts with the circuit board by selectively actuating the keypad to cause flexing of selective portions of the light panel and back reflector toward the circuit board.

2. The assembly of claim 1 further comprising spacers surrounding the contacts.

3. The assembly of claim 2 wherein the spacers are formed by a spacer layer on the one side of the back reflector, the spacer layer having holes extending through the spacer layer in line with the contacts for exposing the contacts for selective contact with respective conductive contacts on the circuit board when the key pad is actuated.

4. The assembly of claim 3 wherein the spacers are formed from a compressible material.

5. The assembly of claim 2 wherein the back reflector and spacers are integrated into a single layer.

6. The assembly of claim 2 wherein the back reflector and spacer layer are vacuum formed or molded as a single unit.

7. The assembly of claim 1 wherein the contacts are conductive ink contacts.

8. The assembly of claim 1 wherein the contacts are printed on the side of the back reflector facing the circuit board.

9. The assembly of claim 1 wherein the panel member is comprised of a plurality of optical fibers.

10. The assembly of claim 1 wherein the panel member is a flexible light guide.

11. The assembly of claim 1 wherein the keypad is made from a flexible elastomeric material.

12. The assembly of claim 1 wherein the keypad comprises a plurality of rigid keys held in a frame or housing for movement of the keys toward and away from the light panel.

13. The assembly of claim 1 wherein the keypad comprises a plurality of rigid keys formed as a single unit with flexible joints between the keys to permit movement of the keys toward and away from the light panel.

14. An integrated switch and backlight assembly comprising a keypad having a plurality of selectively depressible keys, a circuit board spaced from the keypad having circuit board contacts thereon, and a flexible light emitting panel member between the keypad and the circuit board, the panel member having one side facing the keypad from which light conducted through the panel member is emitted for backlighting the keys and an opposite side facing the circuit board, and a back reflector on the opposite side, the back reflector having a plurality of contacts on an exterior surface of the back reflector, portions of the panel member and back reflector being selectively flexed upon selectively depressing one or more of the keys to establish electrical contact of one or more of the contacts on the back reflector with one or more of the circuit board contacts.

15. The assembly of claim 14 further comprising spacers surrounding the contacts on the back reflector.

16. The assembly of claim 15 wherein the spacers are formed by a spacer layer covering the exterior surface of the back reflector, the spacer layer having holes in line with the contacts on the back reflector for exposing the contacts on the back reflector to the circuit board contacts.

17. The assembly of claim 16 wherein the spacers are formed from a compressible material.

18. The assembly of claim 15 wherein the spacers and back reflector are integrally formed into a single layer.

19. The assembly of claim 15 wherein the back reflector and spacer layer are vacuum formed or molded as a single unit.

20. The assembly of claim 14 wherein the contacts on the back reflector are conductive ink contacts printed on the exterior surface of the back reflector.

21. The assembly of claim 14 wherein the panel member is comprised of a plurality of optical fibers.

22. The assembly of claim 14 wherein the panel member is a flexible light guide.

23. The assembly of claim 14 wherein the keypad is made from a flexible elastomeric material.

24. The assembly of claim 14 wherein the keypad comprises a plurality of rigid keys held in a frame or housing for movement of the keys toward and away from the light panel.

25. The assembly of claim 14 wherein the keypad comprises a plurality of rigid keys formed as a single unit with flexible joints between the keys to permit movement of the keys toward and away from the light panel.

* * * * *